US007181801B1

(12) United States Patent
Kresse et al.

(10) Patent No.: US 7,181,801 B1
(45) Date of Patent: Feb. 27, 2007

(54) ABSORBENT STRUCTURE FOR CLEANING SURFACES

(75) Inventors: Frank Kresse, Hilden (DE); Heiko Faubel, Wermekskirchen (DE)

(73) Assignee: Ecolab Inc., St. Paul, MN (US)

( * ) Notice: Subject to any disclaimer, the term of this patent is extended or adjusted under 35 U.S.C. 154(b) by 657 days.

(21) Appl. No.: 10/148,805

(22) PCT Filed: Nov. 25, 2000

(86) PCT No.: PCT/EP00/11767

§ 371 (c)(1),
(2), (4) Date: Aug. 27, 2002

(87) PCT Pub. No.: WO01/39653

PCT Pub. Date: Jun. 7, 2001

(30) Foreign Application Priority Data

| | | |
|---|---|---|
| Dec. 4, 1999 | (DE) | 199 58 533 |
| Mar. 17, 2000 | (DE) | 100 13 044 |
| Apr. 18, 2000 | (DE) | 100 19 211 |
| Apr. 26, 2000 | (DE) | 100 20 366 |

(51) Int. Cl.
*A47L 13/20* (2006.01)
*A47L 13/252* (2006.01)
*A47L 13/255* (2006.01)

(52) U.S. Cl. ..... 15/229.8; 15/229.1; 15/229.4

(58) Field of Classification Search ..... 15/209.1, 15/210.1, 229.1, 229.2, 229.3, 229.4, 229.5, 15/229.6, 229.7, 229.8, 229.9
See application file for complete search history.

(56) References Cited

U.S. PATENT DOCUMENTS

| | | | | |
|---|---|---|---|---|
| 3,341,876 A | | 9/1967 | Campbell | |
| 4,625,356 A | * | 12/1986 | Meili | 15/119.2 |
| 5,066,527 A | | 11/1991 | Newell | |
| 5,227,228 A | * | 7/1993 | Newell | 428/102 |
| 5,638,569 A | * | 6/1997 | Newell | 15/229.6 |
| 5,887,311 A | * | 3/1999 | Kresse et al. | 15/228 |
| 6,233,777 B1 | * | 5/2001 | Kresse et al. | 15/229.4 |

FOREIGN PATENT DOCUMENTS

| | | | |
|---|---|---|---|
| DE | 38 09 279 | | 7/1989 |
| EP | 0 923 902 | | 6/1999 |
| EP | 0 927 536 | | 7/1999 |
| WO | WO 98/06316 | * | 2/1998 |
| WO | WO 98/15221 | * | 4/1998 |

OTHER PUBLICATIONS

DIN 53 923. "Determination of the water absorption of textile surface products". Jan. 1978 (and English translation).

* cited by examiner

*Primary Examiner*—Randall Chin
(74) *Attorney, Agent, or Firm*—Merchant & Gould, P.C.

(57) ABSTRACT

The invention relates to an absorbent structure for cleaning surfaces. The absorbent structure has areas or sections or mixtures comprising different material, these areas, sections or mixtures having either a primarily absorbent effect or a primarily cleaning effect. The structure has a support structure to which the cleaning material has been applied. The aim of the invention is to provide an absorbent structure with greater potential for variation and variants in terms of its cleaning and absorbency properties and/or effects. To this end, the inventive absorbent structure has a pocket or bag-shaped cavity in which pieces or strips of highly absorbent materials are located.

15 Claims, 5 Drawing Sheets

ABSORBENT STRUCTURE FOR CLEANING SURFACES

FIELD OF THE INVENTION

The invention relates to an absorbent structure for cleaning surfaces, which has regions or portions or mixtures of different material characterized as being primarily absorbent or primarily cleaning-active. The absorbent structure also having a carrier structure with cleaning-active material applied to it.

BACKGROUND OF THE INVENTION

Cleaning textiles, cleaning structures and wiping coverings consist predominantly of a mixture of the basic components, cotton and synthetic fibers. The mixture of both basic components is necessary since the components sometimes have conflicting properties. A wiping covering can achieve maximum performance when a large number of positive properties are combined in it.

There are several properties to take into consideration to achieve maximum performance of the cleaning textile, cleaning structure and wiping covering, such as water absorbency, dirt carrying capacity, abrasiveness, washability, and sliding behavior. The water absorbency of cotton is approximately 250% and that of synthetic fibers is virtually 0%. The dirt carrying capacity of cotton is good, whereas the dirt carrying capacity of synthetic fibers is poor, with the exception of microfibers and polypropylene fibers. The abrasiveness of cotton is very low, whereas that of synthetic fibers is high. Additionally, although cotton, polyester and polypropylene are washable up to 95° C., the washing stability of cotton is nevertheless poor, while that of polyester and polypropylene is good. Cotton also has pronounced shrinkage, whereas synthetic fibers exhibit low shrinkage. In addition, cotton displays poor sliding behavior, whereas that of synthetic fibers is good.

Even though cotton absorbs 250% of its own weight of water, a pure cotton fabric is highly unfavorable on account of its poor sliding behavior and its instability during washing. Although properties such as abrasiveness, shrinkage, sliding behavior and washing stability, can be adapted to many situations by appropriately selecting material fractions of cotton and synthetics, the water absorbency is nevertheless, less than 250% when various mixtures of cotton and synthetics are used.

A flat wiping covering for the care of hard floor surfaces, includes a carrier fabric to which material portions are stitched on the underside and on which holder push-in pockets are stitched on the top side of the longitudinal ends is known from DE 38 09 279 C1. This describes a wiping covering for floor care, preferably having a carrier fabric with holder push-in pockets stitched on the top side of the longitudinal ends of the carrier fabric and material attached on the underside of the carrier fabric for the absorption of dirt and moisture. The wiping covering has a low dead weight, good absorbency and a high water storage capacity. In this case, the underside material is in the form of sponge or nonwoven-cloth material with high liquid absorbency. The sponge or non-woven cloth material form a plurality of strips extending over the length of the carrier fabric and are arranged in rows adjacent and parallel to one another. The strips of sponge or non-woven cloth material being attached to the carrier fabric by stitching. The water absorbency of the sponge or nonwoven cloth material is up to 3,600 g/m$^3$, and the relative water absorption of the sponge or nonwoven cloth material is up to 1,400%. The water absorbency being determined according to DIN 53 923.

However, there is room for improvement in the flat wiping covering according to DE 38 09 279 C1. Considerable problems can arise in the handleability of the flat wiping coverings since the strips of sponge or non-woven cloth material are stitched to the carrier fabric, for example, reversible shrinkage of 30% in relation to the wet state can occur upon drying. In the wet state, the coverings have a calculated length, in which the covering sheet of the carrier material is flat. In the dry state, shrinkage of the sponge cloth lamellae of approximately 30% in relation to the cotton/polyester carrier fabric of the covering sheet occurs, leading to extreme distortions of the covering upon drying. The large degree of shrinkage of the sponge or non-woven cloth materials upon drying creates difficulty when inserting the wiping covering device into the holder push-in pockets of the carrier fabric. Nevertheless, forcibly inserting the wiping device into the holder push-in pockets damages the wiping covering. Even though the covering can be dampened before the wiping covering device is inserted into the push-in pockets of the covering, this is nevertheless disadvantageous since it entails a considerable amount of time and effort in handling. A further disadvantage is that the sponge or non-woven material is stitched onto the carrier fabric resulting in the water absorbency of the material being markedly reduced in the vicinity of the seams.

An improvement in water absorbency or water absorption-power was achieved, for example, in the patent specification DE 38 09 279 C1, already mentioned above, in that, in addition to cotton and synthetic material, a sponge or nonwoven cloth material with a high viscose fraction is also used. Water-absorbing materials, such as sponge or wood, work by replacing their air filled cavities in the dry state with liquid, when they are dipped into a liquid. This liquid absorption, however, is necessitated by the dipping of the material into the liquid, making it difficult for cleaning liquid to be absorbed from hard floor surfaces when the water-absorbing materials are in their dry state. The water-absorbing materials in the dry state even fail to appreciably absorb liquid in the case of a residual quantity of 15 g of cleaning liquid per square meter, which amounts to only fractions of a millimeter of thickness, since liquid absorption is necessitated by dipping the material in the liquid. Moreover 15 g of cleaning liquid per square meter represents an unacceptable level of moisture for coated PVC floors.

It is therefore necessary to have a different form of water absorbency which may be described by water suction capacity, for a wiping covering absorbing cleaning liquid. In this case, the material picks up the liquid on the contact interfaces via the suction effect, so that the liquid is downright sucked up. While a residue of 15 g of cleaning liquor per square meter on hard floor surfaces represents an unacceptable level of moisture, the aim is to achieve a residual liquid quantity of 10 g/m$^2$. It was observed that, in the case of a residual moisture of 11 g/m$^2$, the cleaning performance falls abruptly.

This negative jump is explained by the free movability of the pigment dirt in the relatively higher moisture film on the wiping surface. This possibility is eliminated below 11 g/m$^2$. The dirt can no longer escape from the wiping materials, but, instead, during the wiping movements, it adheres to the material of the cleaning-active side and can be removed in this way.

SUMMARY OF THE INVENTION

The object of the invention is to provide a solution which, in the case of an absorbent structure for the cleaning of surfaces, affords, in terms of its design possibilities, variations and variabilities which are broadened in respect of its cleaning-active and absorbent properties and or actions.

In an absorbent structure of the type initially mentioned, this object is achieved according to the invention in that the structure has a pocket-shaped or bag-shaped cavity with snippets or strips of highly absorbent material arranged in it.

The invention affords the possibility of arranging the primarily absorbently active material with highly absorbent properties on the absorbent structure elsewhere and independently of the regions or portions with material having primarily a cleaning-active effect. Preferably and in particular, the highly absorbent material is formed and arranged on the opposite side of the cleaning-active surface of the primarily cleaning-active material. Since the cleaning-active materials are separate and placed independent of the highly absorbent material, the cleaning-active material can be designed specifically for its cleaning-promoting action, while the highly absorbent material can be specifically designed for its water absorption action or the absorbency action.

The cleaning structure according to the invention has, overall, a very high liquid absorbency as a result of the snippets or strips which, in particular, are loosely arranged within the closed cavity. The properties of the cleaning structure, such as abrasiveness, dirt carrying capacity, sliding behavior, etc., are determined by the properties of the primarily cleaning-actively acting material. In this way, the positive properties both of the cavity content, to be precise of the highly absorbent snippets, and of the outer material, including the carrier structure, are combined and optimized, without their respective properties having an adverse influence on one another.

In one embodiment, the invention provides for the snippets or strips to be arranged loosely in the cavity, with the cavity being closed on all sides.

A particularly preferred use of the absorbent structure is its design as a flat wiping covering for the care of hard floor surfaces.

In the known abovementioned flat wiping covering, the technical problem is also, in particular, that of incorporating highly absorbent materials with other materials having different materials properties. In particular, the disadvantages of the highly absorbent materials having increased shrinkage upon drying in comparison with the low shrinkage of the carrier sheet material. It is an object to of the invention to provide a wiping covering that avoids the disadvantages arising from the different shrinkage behavior and from the impairment of the water absorbency in the seam region.

To solve this problem the invention provides the absorbent structure be designed as a flat wiping covering for the care of hard floor surfaces. The absorbent structure includes a carrier structure, to which material portions of cleaning-active and/or absorbent material or material combinations are stitched on the underside and to which holder push-in pockets are stitched on the top side of the longitudinal ends of the carrier structure. The carrier structure being absorbent or water-permeable. The absorbent structure also including a covering sheet, in which all sides of the covering sheet are stitched to the top or upper side of the carrier structure, forming a cavity between the carrier structure and the covering sheet. The cavity being filled with snippets or strips of highly absorbent material loosely arranged on the carrier structure.

The advantage of a flat wiping covering of this type is that, overall, it has a very high liquid absorbency, to which contribute in each case the material portions attached to the carrier structure on the underside, the carrier fabric and, predominantly, the snippets arranged loosely on the carrier fabric. The flat wiping covering is consequently suitable both for wiping wet hard floor surfaces and for applying cleaning liquid to the hard floor surfaces. In this case, the transport of liquid between the individual covering parts takes place via the absorbent material parts.

For example, when wet surfaces are being wiped, the liquid is first sucked up from the surface by the underside material portions and transferred from these to the carrier fabric and transferred from the carrier fabric to the snippets arranged on the carrier fabric.

The wiping covering is dipped into a container having the cleaning liquid prior cleaning a floor, so that the absorbent parts of the covering are saturated with the washing liquid. When the flat wiping covering is set down with the aid of the wiping appliance, the underside material portions come into contact with the floor first. As soon as these and, as a result, the carrier fabric have discharged the liquid stored in them, brief pressure on the snippets is subsequently sufficient to express the liquid stored in them and discharge it via the carrier fabric and the underside of the carrier fabric to the material portions and onto the surface to be cleaned.

Since the absorbency and the liquid transportability are accomplished by the cotton fraction present in the mixture of the material portions and the water storage capacity is accomplished primarily by the highly absorbent snippets or strips present in the covering it is possible to at least partially replace the material portions on the underside of the carrier sheet with nonabsorbent materials, for example synthetic fibers. The use of synthetic fibers enhances other properties important for the cleaning performance, such as abrasiveness and/or sliding behavior. The use of synthetic fibers also improves the shrinkage stability and washing stability of the material mixture of the absorbent structure.

Moreover, since the snippets of highly absorbent material are arranged loosely in the cavity and on the carrier fabric, the difference in shrinkage behavior properties does not have an effect on the dimensional stability of the coverings.

Preferably, the cleaning-active material or the material portions of this kind are in the form of fringes, loops, rat's tails or lamellae. It is also preferred that it or they be arranged, distributed, over the entire underside surface of the carrier fabric.

It is proposed, furthermore, that the cleaning-active material or the material portions of this kind consist of a synthetic material, in particular polyester, or microfibers or cotton or a mixture of these substances. The choice of materials depends on the desired cleaning properties.

It is particularly advantageous, furthermore, if the flat wiping covering has a peripheral bead which consists, in particular, of the same material as the material portions attached to the carrier fabric. Particular advantages arise when the bead is stitched in the form of a hem to the flat wiping covering in such a way that the edge of the longitudinal strip/longitudinal strips which projects into the middle of the underside of the covering lies loosely on this underside. This results in two different effects, depending on the wiping direction. The front longitudinal strip of the bead lies flat and is between the underside and the wiping surface. By contrast, the opposite, that is to say rear longitudinal strip of the bead rises up and thereby forms a stripper which increases the cleaning performance even further.

In a further important advantageous embodiment, the cavity has a plurality of, in particular two to five, chambers for the snippets or strips. The subdivision of the wiping covering into a plurality of chambers allows a more uniform distribution of the snippets, even when the covering is subjected to differing stress. Without this subdivision, it could happen that, for example in a wiping covering, the snippets or strips slip toward one end of the usually elongate flat wiping covering, so that the other end will be free of snippets. It is advantageous, moreover, if these chambers are divided off in the longitudinal direction. Such a division does not lead to an impairment of the cleaning performance. If the pockets were divided in the transverse direction, the corresponding seams would give rise to depressions on the cleaning-active side of a wiping mop, so that the contact of the wiping covering with the surface to be wiped would be prevented there and the wiped surface would acquire a stripy appearance.

Furthermore, it is also proposed, for a flat wiping covering, that the holder push-in pockets be stretchable. The wiping covering can thus be used both for fold-down holders and for rigid holders. In the latter case, it is necessary for the holder push-in pockets to be stretchable.

The invention does not, however, relate only to flat wiping coverings. The absorbent structure for the cleaning of surfaces may also be provided, in another particularly advantageous refinement, for manual use, that is to say without wiping appliances being employed. For this purpose, it is proposed that the absorbent structure for the cleaning of surfaces be designed as a bag, and that the carrier structure have on its outside bristles, in particular synthetic bristles, as cleaning-active material. This bag is capable, on the one hand, of sucking up a large quantity of water and, on the other hand, of holding it and discharging it onto the surface to be wiped. At the same time, the outside provided with bristles ensures a good cleaning action. The bristle trimming brings about the necessary abrasiveness. Dirt particles are removed from the smallest depressions of the surface being wiped by means of the bristle ends. An absorbent structure of this kind, having a bag-shaped cavity, can easily be produced as a sponge substitute in a size suitable for grasping with one hand.

Moreover, both as regards the sponge bag and as regards the flat wiping covering, it is advantageous if the snippets or strips of highly absorbent material suck up 250 to 1,500% of their own weight of liquid.

It is advantageous, furthermore, if the highly absorbent material consists at least predominantly of viscose, as also provided by the invention.

In a further embodiment, the invention provides a system which consists of the absorbent structure of the present invention and of a wiping device with a handle and a wiping plate, connected or connectable to the handle via a preferably cardanic joint, for holding the absorbent structure on an underside of the wiping plate, and of an expressing device for the wiping device, the expressing device having a bearing surface provided with perforations and a counterbearing means arranged at a distance from said bearing surface, so that the wiping plate can be introduced between the bearing surface and the counterbearing means with a downwardly directed introduction movement and can be pressed, with its underside holding the absorbent structure, against the bearing surface by tilting, being supported at the same time on the counterbearing means. A wiping device of this kind and an expressing device of this kind, which cooperate in the way described, are known from WO-A-98/06316 and GB-C-330 543 and also from the Applicant's German patent application 100 13 044. Express reference is made thus far to the disclosure content of these publications.

BRIEF DESCRIPTION OF THE DRAWINGS

Exemplary embodiments of the invention are described in more detail below with reference to drawings in which.

DETAILED DESCRIPTION OF THE INVENTION

In all the drawings, identical parts have the same reference symbols and, if appropriate, are not mentioned separately for each drawing.

It was shown, in tests, that viscose sucks up 15 times its own weight of liquid without mechanical action from outside, such as compression and expansion. These measurements were conducted with reference to DIN 53 923 and, in addition to this relative liquid absorption, showed wetting times of less than four seconds and a suction rate of more than 5 cm/s. Depending on the fraction of viscose in material mixtures with cotton, the liquid absorption capacity of the mixture is around 2.5 to 15 times its own weight, corresponding 250 to 1,500%. Snippets or strips of such a highly absorbent material are used as material having a highly absorbent action in the exemplary embodiments of the invention which are described below.

Figure 1:
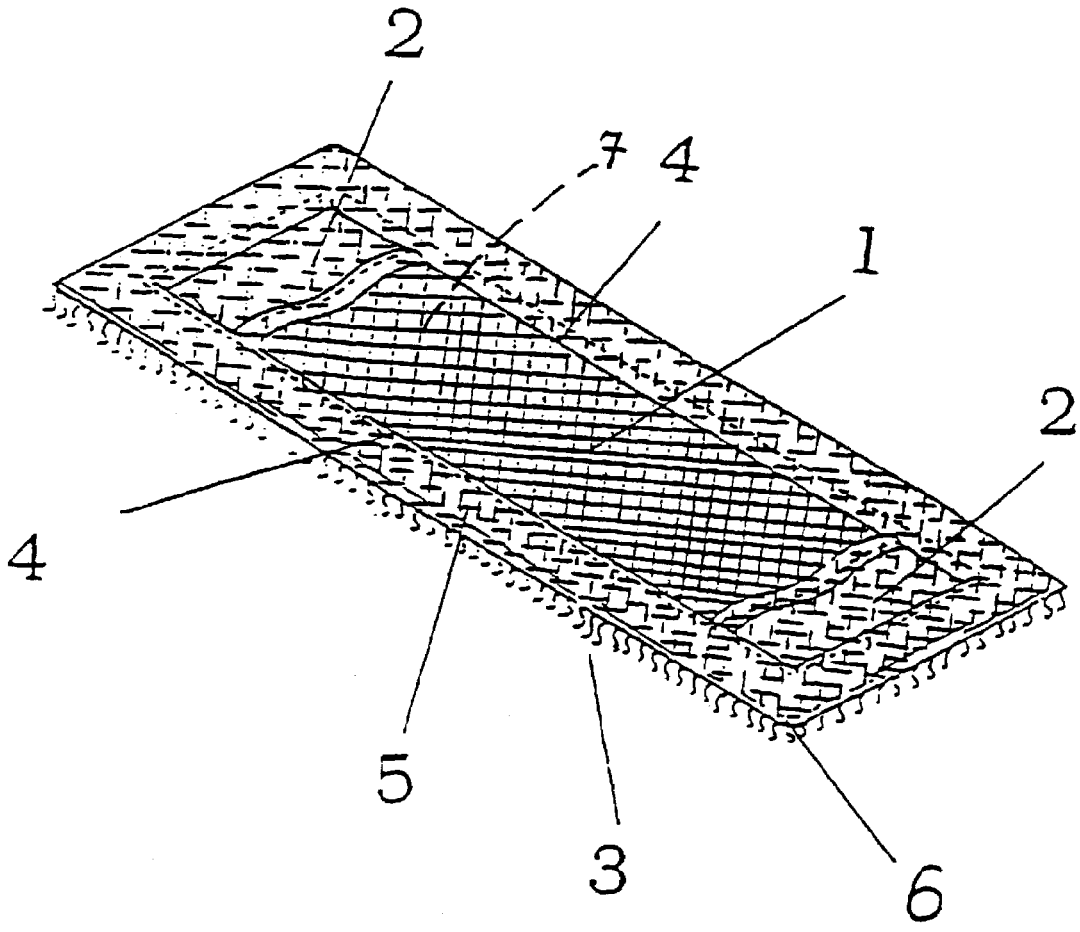
FIG. 1 shows a perspective illustration of a flat wiping covering according to the invention in a first exemplary embodiment, in an oblique view from above.

In FIG. 1, an absorbent structure for the cleaning of surfaces in the form of a flat wiping covering is illustrated in an oblique view from above. In the case of the flat wiping covering, a covering sheet 5 is applied to a carrier structure 6, and stitched all-around the edges of the covering sheet to the carrier structure 6 designed as a woven or knitted fabric, referred to as a carrier fabric in the case of the flat wiping covering. Fastened to the carrier structure on the underside are material portions which consist of a material acting in a primarily cleaning-active way, that is to say having an abrasive, scouring and/or dirt-absorbing action, and which, in the exemplary embodiment illustrated, are in the form of fringes. However, these material portions way also have some absorbency. Holder push-in pockets 2 are stitched to the covering sheet 5 at the longitudinal ends. FIG. 1 illustrates a cutout 4 of the covering sheet 5, so that it is possible to look through the opening 7 at snippets 1 arrange loosely on the carrier structure. These snippets 1 lie on the carrier structure 6 in a pocket-shaped cavity formed by the stitched-on covering sheet 5 and the carrier structure 6.

The ends of a folding holder can be pushed into the stitched-on holder push-in pockets 2 for fastening. By means of the spread: folding holder, during wiping, a surface pressure can easily be exerted on the covering sheet 5 and consequently on the highly absorbent snippets 1 arranged below the covering sheet 5 and on the carrier structure 6, in order, depending on the magnitude of the pressure exerted, to express completely or partially a liquid quantity which is stored in the material. In exactly the same way, before the flat wiping covering is used for dry wiping, the stored liquid can be expressed from the flat wiping covering by corresponding pressure with the folding holder, so that the flat wiping covering has full suction capacity for wiping up.

Figure 6A:
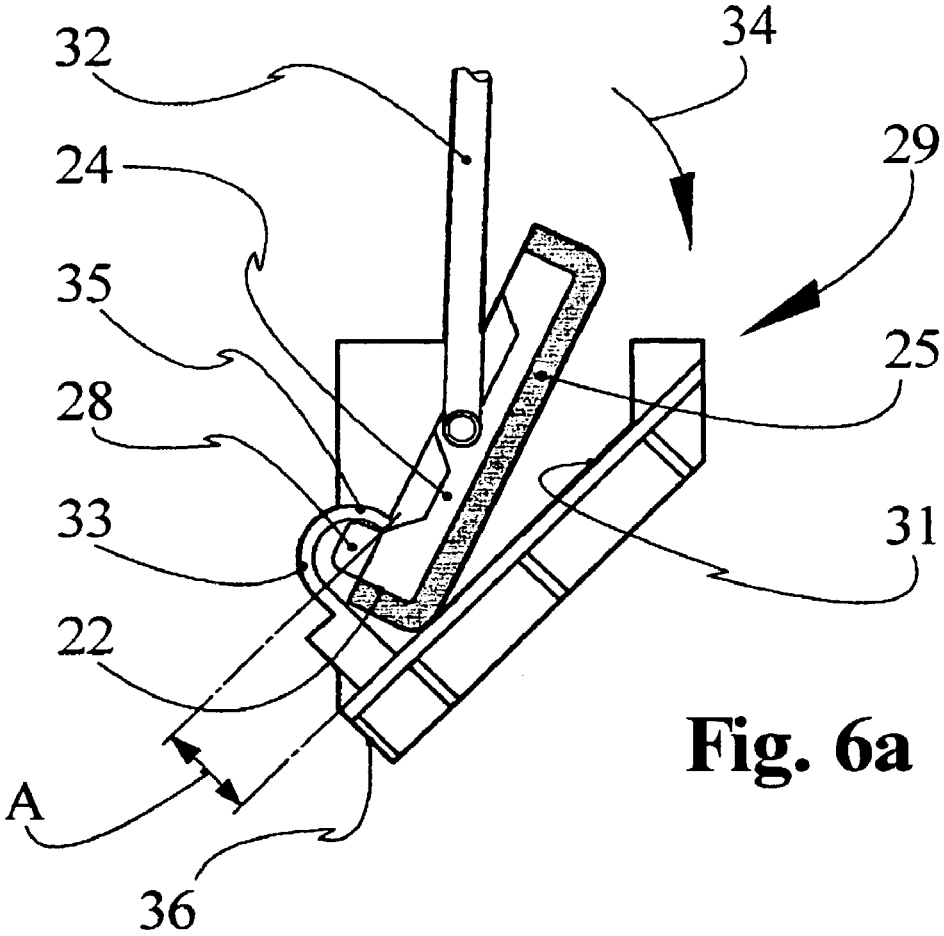
Figure 6B:
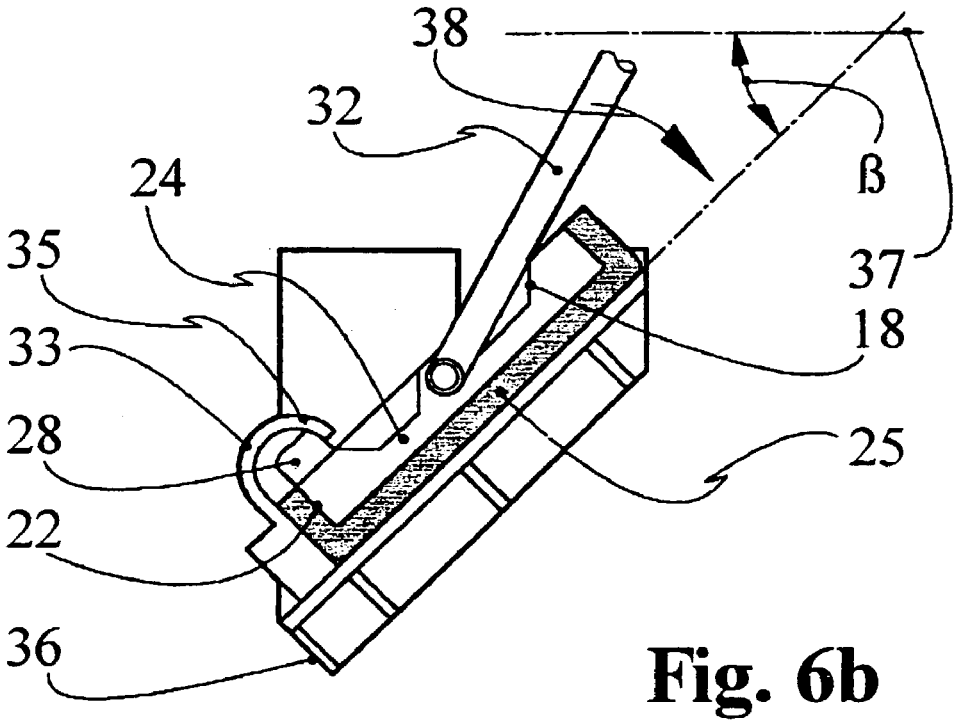

FIGS. 6*a* and 6*b* show a diagrammatic sectional view of an expressing device 29 suitable for this purpose, in FIG. 6*a* during the introduction of the wiping plate 24 and in FIG. 6*b* during the expressing of the flat wiping covering 25. FIG. 6*a* illustrates the introduction movement 34, by means of which the wiping device or its wiping plate 24 is introduced, with a longitudinal edge 22 in front, into the expressing device 29 and between the bearing surface 31 provided with perforations and the counterbearing means 33 or its counterbearing elements 33. The holding portions 28 assigned to or adjacent to the introduced longitudinal edge 22 are thereby brought into engagement with the counterbearing means 33 or its counterbearing elements 33 or engagement in this respect becomes possible, so that securing portions 35, protruding or projecting relative to the bearing surface 31, of the counterbearing means or of the counterbearing elements 33 engage or can engage behind the introduced holding portions 28 or their undercuts.

How far the introduction movement 34 must involve a pivoting or tilting of the wiping plate 24 about its longitudinal axis depends on the clear distance A of the securing portions 35 from the bearing surface 31 in relation to the overall height of the wiping plate 24 together with the flat wiping covering 25 and with the holding portions 28 projecting the highest on the top side. Preferably, as indicated in FIG. 6*a*, inward pivoting is necessary, so that the wiping plate 24 is secured positively against moving out of the expressing device 29 when the wiping plate 24 together with the flat wiping covering 25 lies over its full area on the bearing surface 31, as shown in FIG. 6*b*.

It may also be gathered from FIGS. 6*a* and 6*b* that the expressing device 29, illustrated in its state of use, is designed in such a way that the bearing surface 31 is inclined at an angle β relative to the horizontal 37. Preferably, the angle of inclination is between 30° and 60°, in particular about 45°. In combination with a counterbearing means arranged in the lower region, here in the region of the lower longitudinal edge 36, this results in a simple introduction and expressing of the wiping device.

FIG. 6*b* illustrates the expressing device. With the wiping plate 24 introduced, the handle 32 is folded down or pivoted about the longitudinal axis away from the counterbearing means according to the arrow 38. The handle 32 or part of the joint in this case comes to bear on the wiping plate 24, here, for example, in the region of the V-shaped recess 18, so that further pressure on the handle 32 in the direction of the arrow 38 results in the wiping plate 24 being pressed down with its underside toward the bearing surface 31, as a consequence of which the flat wiping covering 25 is expressed. In this case, the counterbearing means or its securing portions 35 cooperate, in particular in a hinge-like manner, with the introduced holding portions 28 of the wiping plate 24, the counterbearing means forming virtually the pivot point for a one-armed lever formed from the wiping plate 24 and the adjoining handle 32. By means of this one-armed lever, it becomes possible for the flat wiping covering 25 to be expressed in a simple way on the articulated wiping device.

The transport of liquid during liquid absorption and during liquid discharge takes place via the absorbent parts of the flat wiping covering. In particular liquid moves from the underside material portions of primarily cleaning-active material to the at least water-permeable carrier structure to the snippets 1 and/or strips arranged on the carrier structure, and vice versa. There is no need for the material of the holder push-in pockets 2 and the covering sheet 5 to be absorbent and to have liquid absorbency.

Only the fringe-like material portions 3 arranged along the edge can be seen in FIG. 1. The material portions may also be in the form of loops, rat's tails or lamellae and, as a rule, are arranged so as to be distributed essentially over the entire underside surface of the carrier structure 6. The underside material portions may be arranged in a straight line next to one another or along circular or zigzag paths next to one another.

Since the liquid absorbency of the underside material portions having a primarily cleaning-active action make up only a relatively small fraction of the liquid absorption capacity of the entire flat wiping covering, while the snippets or strips arranged loosely in the pocket make up a very large fraction or the essential fraction of the liquid absorption capacity, the fraction of absorbent materials in these underside material portions may be reduced in favor of the fiber fractions which positively influence other necessary properties, such as abrasiveness and slidability.

Figure 2:
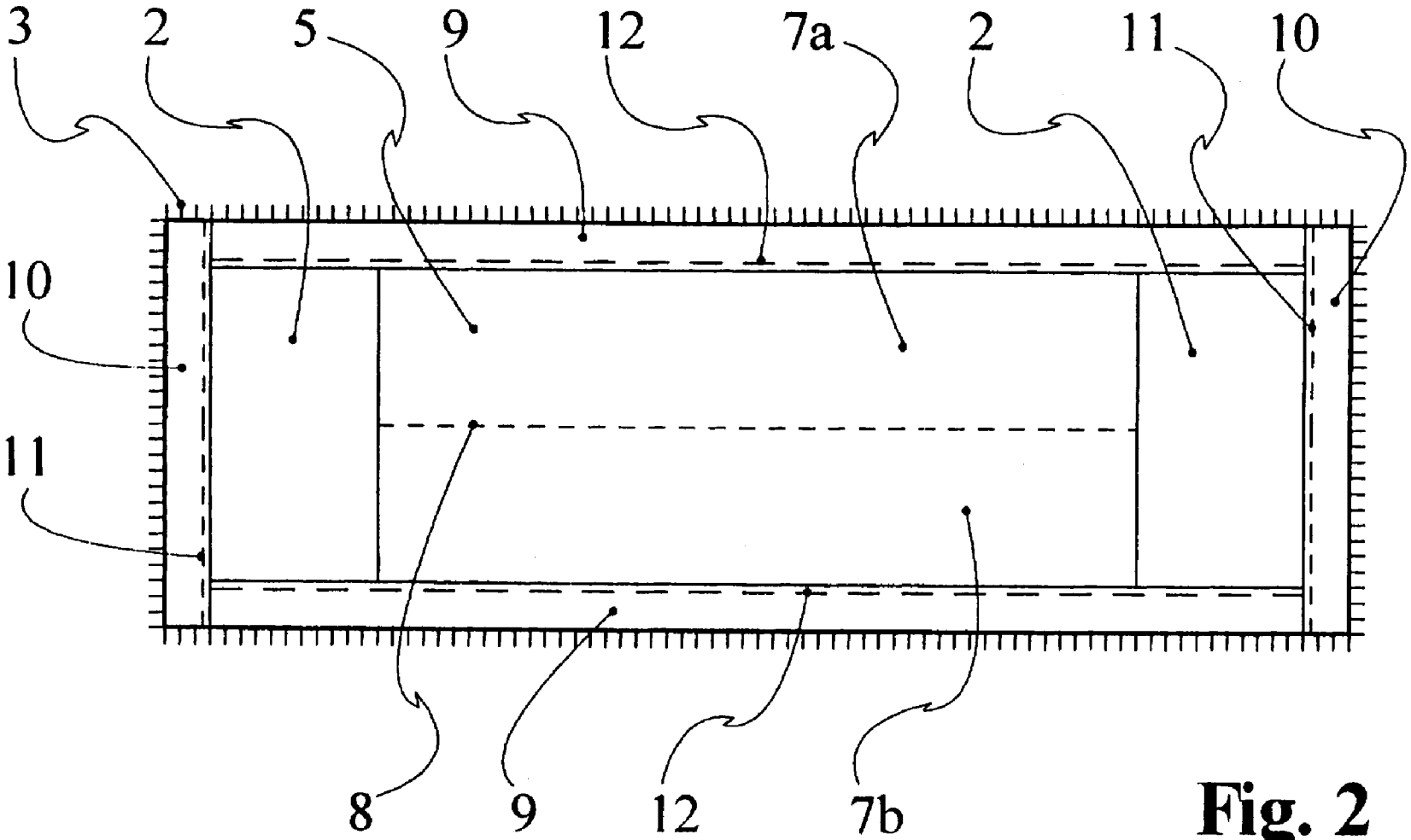
FIG. 2 shows a plan view of the top side of a flat wiping covering according to a second exemplary embodiment of the invention.
Figure 3:
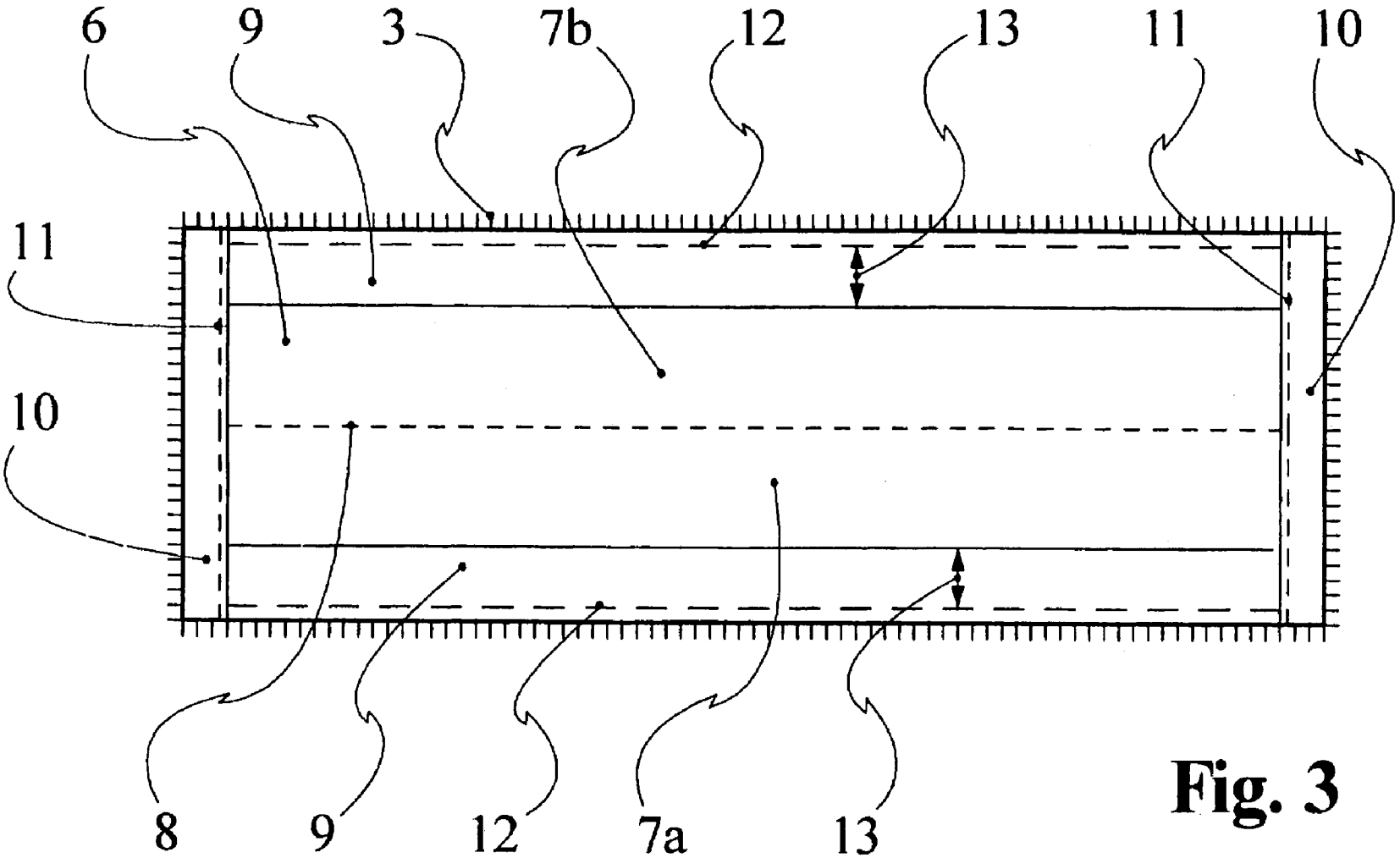
FIG. 3 shows a plan view of the underside of the flat wiping covering according to FIG. 2.

FIG. 2 shows a plan view of the top side of a particularly preferred exemplary embodiment of a flat wiping covering according to the invention. The highly absorbent snippets 1, which cannot be seen in this figure, are arranged in two chambers 7*a*, 7*b* which extend in the longitudinal direction and which are delimited at the top by the covering sheet 5 and on the underside by the carrier structure 6 (FIG. 3). The two chambers 7*a* and 7*b* are divided off by a continuous longitudinal seam 8. This longitudinal seam also runs below the holder push-in pockets 2 which, in the present case, are designed elastically.

The carrier structure 6 on the underside of the flat wiping covering (FIG. 3) consists, here, of a microfiber with a pile height of 2 to 10 mm. The term "pile height" relates to the length of the outwardly protruding loops or fringes.

A peripheral bead, which is formed by two longitudinal strips 9 and two transverse strips 10, consist of the same material. The transverse strips 10 are stitched at their outer edges to the covering sheet 5 or the carrier structure 6. This is indicated by the seams 11 passing through the flat wiping covering. In contrast to this, the two longitudinal strips 9 are stitched to the covering sheet 5, in the region of their edges, only on the top side of the flat wiping covering. The corresponding longitudinal seams bear the reference symbol 12. By contrast, on the underside, the longitudinal strips 9 are significantly wider, and the longitudinal seams 12, which, like the transverse seams 11, pass through the entire flat wiping covering, lie nearer to the edge of the flat wiping covering than to the edges to the longitudinal strips 9, so that a relative wider part region 13 projects, unstitched, into the middle of the covering on both longitudinal sides of the latter.

When wiping transversely to the longitudinal direction of the covering, the two longitudinal strips 9 behave differently. The front longitudinal strip lies flat, between the carrier structure 6 and the wiping surface. By contrast, the unstitched edge of the wider region 13 of longitudinal strips 9 located further to the rear can move and form a stripper which absorbs liquid and dirt and thereby increases the cleaning performance.

It may also be pointed out that, in the present exemplary embodiment, the covering sheet 5 and the carrier structure 6 consist of different material. The covering sheet 5 consists of a firm woven textile. It is also possible, however, to use only microfiber or another cleaning-active textile both for the covering sheet 5 and for the carrier structure 6.

Figure 4:
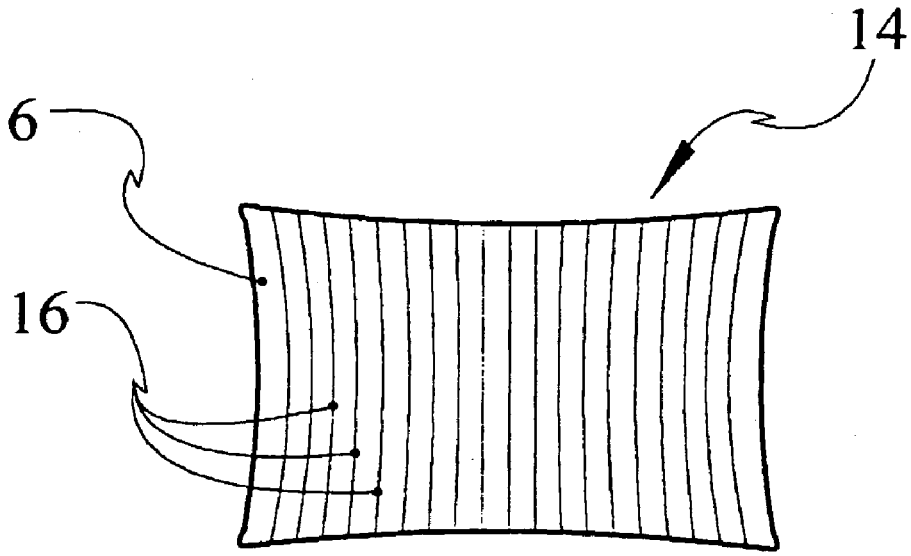
FIG. 4 shows a plan view of a cleaning structure according to the invention (third exemplary embodiment) designed as a bag.
Figure 5:
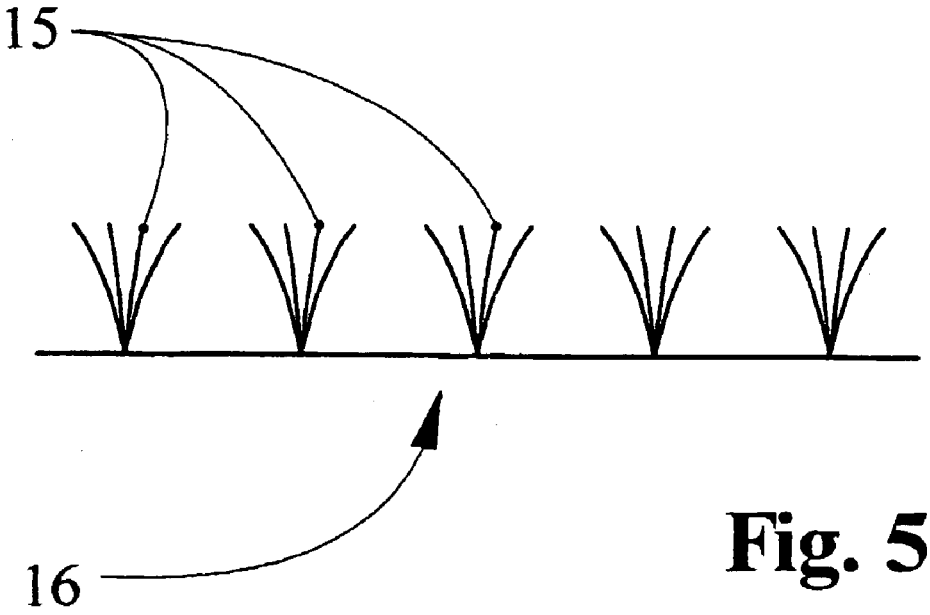
FIG. 5 shows part of a bristle row on the top side of the bag according to FIG. 4, and FIG. 6*a*/6*b* show diagrammatic sectional views of an expressing device.

FIGS. 4 and 5 illustrate diagrammatically a further exemplary embodiment of the invention. Here, the absorbent structure for cleaning surfaces consists of a bag filled with the highly absorbent snippets or strips. This exemplary embodiment is intended advantageously to replace a conventional sponge.

To be precise, conventional known sponges do not suck up any water, for example, as a result of capillary action. The foamed body of conventional sponges admittedly has a large number of open pores and, when the sponge is immersed, water runs into these cavities. This operation can be accelerated if the sponge is dipped in the compressed state under water and is expanded there. Sponges which are covered on one side with a pad are also known. The actual sponge body serves as a grip for handling an abrasive scouring pad of this kind. However, wet surfaces cannot be dried off with sponges of this kind.

In contrast to this, the bag according to the invention is suitable not only for cleaning of surfaces, but, in addition, for wiping dry, as a result of its high-suction snippets or strips as material having a primarily absorbent action.

The outer casing of the bag 14 in FIG. 4, said casing surrounding the snippet-containing cavity on all sides, is formed by the carrier structure 6 which is water-permeable and which carries a close-mesh bristle trimming 15, 16. The bristles 15, which are arranged in rows 16 on the carrier structure 6, bring about the desired abrasiveness, that is to say have a primarily cleaning-active action. A bristle row 15,16 of this kind is illustrated, enlarged, in FIG. 5. Dirt can be removed from the smallest possible depressions by means of the bristle ends. The bristles may also have some absorbency.

The bristles are preferably 1 to 10 mm long and consist of a synthetic material, so that, in the sanitary sector, fittings are protected and are not scratched.

The bag 14 is filled with the highly absorbent snippets of sponge cloth material, already discussed above, as material having a primarily absorbent action, which are capable of sucking up preferably up to 1,500% of their own weight of water. The bag according to the invention is therefore particularly suitable for drying off wet surfaces, since the snippet-like or strip-shaped material readily sucks up the water to be eliminated.

The individual materials or material portions of the absorbent structure may be produced as a textile, woven or knitted fabric.

Within the scope of the foregoing disclosure, the terms "absorbent" and "absorbency" also mean "water absorbent" or "water absorbency" or "water suction power" or "water suction capacity", so that these terms are to that extent used as synonyms.

A particularly suitable material for the highly absorbent snippets/strips is pieces which are sold by the company Kalle/Nalo and are produced during the production of sponge cloths as waste pieces from their edge region and which consist ⅔ of viscose and ⅓ of cotton fibers, preferably for dimensional stablization.

The invention claimed is:

1. An absorbent structure for cleaning surfaces, comprising:

a carrier structure having an upper side, a bottom side and a longitudinal direction defining longitudinal ends, material portions, wherein said material portions are fastened to the bottom side of said carrier structure, a covering sheet having sides, wherein all sides of the covering sheet are attached to the upper side of the carrier structure, a cavity defined by the upper side of the carrier structure and formed between the upper side of the carrier structure and the covering sheet, snippets of highly absorbent material, wherein the snippets of highly absorbent material are loosely arranged in said cavity, and holder push-in pockets, wherein said holder push-in pockets are stitched to the covering sheet at longitudinal ends and said material portions are stitched on the bottom side of the carrier structure, and wherein all sides of the covering sheet are stitched to the upper side of the carrier structure.

2. The absorbent structure of claim 1, wherein the cavity is closed on all sides.

3. The absorbent structure of claim 1, wherein the material portions are fringes, loops, rat's tails or lamellae.

4. The absorbent structure of claim 1, wherein the material portions are selected from the group consisting of synthetic material, microfiber, cotton, and mixtures thereof.

5. The absorbent structure of claim 4, wherein the synthetic material is polyester.

6. The absorbent structure of claim 1, wherein the absorbent structure further comprises a peripheral bead.

7. The absorbent structure of claim 6, wherein the material of peripheral bead and the materials portions is the same material.

8. The absorbent structure of claim 1, wherein the cavity has a plurality of chambers for the snippets.

9. The absorbent structure of claim 8, wherein the chambers are divided in the longitudinal direction.

10. The absorbent structure of claim 8, wherein the cavity comprises two to five chambers for the snippets.

11. The absorbent structure of claim 1, wherein the holder push-in pockets are stretchable.

12. The absorbent structure of claim 1, wherein the material portions are synthetic bristles applied to the bottom side of the carrier structure.

13. The absorbent structure of claim 1, wherein the snippets of highly absorbent material have a liquid absorbency of about 250% to about 1,500%.

14. The absorbent structure of claim 1, wherein the snippets of highly absorbent material consists at least predominantly of viscose.

15. A system comprising:

the absorbent structure of claim 1, a wiping device having a handle and a wiping plate having an underside, wherein the wiping plate is connectable to the handle by a cardanic joint, and the absorbent structure is held onto the underside of the wiping plate, and an expressing device for the wiping device, the expressing device having a bearing surface provided with perforations, and a counterbearing element arranged at a distance from said bearing surface, so that the wiping plate and absorbent structure can be introduced between the bearing surface and the counterbearing element of the expressing device.

* * * * *